US006764646B2

(12) United States Patent
Crook et al.

(10) Patent No.: US 6,764,646 B2
(45) Date of Patent: Jul. 20, 2004

(54) NI-CR-MO-CU ALLOYS RESISTANT TO SULFURIC ACID AND WET PROCESS PHOSPHORIC ACID

(75) Inventors: Paul Crook, Kokomo, IN (US); Martin L. Caruso, Ruston, LA (US)

(73) Assignee: Haynes International, Inc., Kokomo, IN (US)

( * ) Notice: Subject to any disclaimer, the term of this patent is extended or adjusted under 35 U.S.C. 154(b) by 203 days.

(21) Appl. No.: 10/170,945

(22) Filed: Jun. 13, 2002

(65) Prior Publication Data

US 2003/0231977 A1 Dec. 18, 2003

(51) Int. Cl.[7] ..... C22C 19/05

(52) U.S. Cl. ..... 420/445; 420/450; 420/453; 420/454; 420/457; 420/458; 148/427; 148/428

(58) Field of Search ..... 148/427, 428; 420/442, 445, 450, 452, 454, 457, 458, 459

(56) References Cited

U.S. PATENT DOCUMENTS

| | | | | | |
|---|---|---|---|---|---|
| 3,565,611 | A | | 2/1971 | Economy | |
| 4,171,217 | A | | 10/1979 | Asphahani et al. | |
| 4,400,210 | A | * | 8/1983 | Kudo et al. | 420/443 |
| 4,410,489 | A | | 10/1983 | Asphahani et al. | |
| 4,421,571 | A | * | 12/1983 | Kudo et al. | 148/501 |
| 4,778,576 | A | | 10/1988 | Bon et al. | |
| 4,789,449 | A | | 12/1988 | Bon et al. | |
| 4,876,065 | A | | 10/1989 | Rockel et al. | |
| 5,424,029 | A | | 6/1995 | Kennedy et al. | |
| 5,529,642 | A | | 6/1996 | Sugahara et al. | |
| 6,623,869 | B1 | * | 9/2003 | Nishiyama et al. | 428/685 |
| 2002/0195175 | A1 | * | 12/2002 | Ishida et al. | 148/427 |
| 2003/0005981 | A1 | * | 1/2003 | Ogawa et al. | 148/428 |

FOREIGN PATENT DOCUMENTS

| | | |
|---|---|---|
| JP | 09-194973 | 7/1997 |

* cited by examiner

*Primary Examiner*—John P. Sheehan
(74) *Attorney, Agent, or Firm*—Buchanan Ingersoll, P.C.

(57) ABSTRACT

A nickel-chromium-molybdenum-copper alloy that is resistant to sulfuric acid and wet process phosphoric acid contains in weight percent 30.0 to 35.0% chromium, 5.0 to 7.6% molybdenum, 1.6 to 2.9% copper, up to 1.0% manganese, up to 0.4% aluminum, up to 0.6% silicon, up to 0.06% carbon, up to 0.13% nitrogen, up to 5.1% iron, up to 5.0% cobalt, with the balance nickel plus impurities.

8 Claims, No Drawings

NI-CR-MO-CU ALLOYS RESISTANT TO SULFURIC ACID AND WET PROCESS PHOSPHORIC ACID

FIELD OF THE INVENTION

This invention relates generally to non-ferrous metal alloy compositions, and more specifically to nickel-chromium-molybdenum-copper alloys that provide a useful combination of resistance to sulfuric acid and resistance to "wet process" phosphoric acid.

BACKGROUND OF THE INVENTION

One of the steps in the manufacture of fertilizers involves a reaction between phosphate rock and sulfuric acid, to create "wet process" phosphoric acid. In this reaction step, there is a need for materials resistant to both sulfuric acid and "wet process" phosphoric acid. Alloys currently considered for such applications include austenitic stainless steels and nickel-iron alloys containing high levels of chromium, in the approximate range 28 to 30 wt. %. Among these are G-30 alloy (U.S. Pat. No. 4,410,489), Alloy 31 (U.S. Pat. No. 4,876,065), and Alloy 28. Alloys with even higher combined resistance to these two acids are sought, however.

It is known that chromium is beneficial to the corrosion resistance of iron-nickel and nickel-iron alloys in "wet process" phosphoric acid. It is also known that copper benefits the resistance of these same alloy systems to sulfuric acid, and that molybdenum is generally beneficial to the corrosion resistance of nickel alloys. The use of these alloying additions, however, is constrained by thermal stability considerations. In other words, if the solubilities of these elements are exceeded by a significant amount, it is difficult to avoid the precipitation of deleterious intermetallic phases in the microstructure. These can influence the manufacturing of wrought products and can impair the properties of weldments.

Given that chromium, molybdenum and copper are more soluble in nickel than iron, it follows that higher levels of these elements are possible in low iron, nickel alloys. It is not surprising, therefore, that molybdenum-bearing nickel alloys with high chromium contents exist. U.S. Pat. No. 5,424,029 discloses such a series of alloys, although these require the addition of tungsten, in the range 1 to 4 wt. %, and do not require copper. U.S. Pat. No. 5,424,029 states that such alloys possess superior corrosion resistance to a variety of media, although they were neither tested in pure sulfuric acid nor "wet process" phosphoric acid. Notably, U.S. Pat. No. 5,424,029 states that the absence of tungsten results in a significantly higher corrosion rate. Also notably, it states that corrosion resistance worsens significantly when copper is present at levels of 1.5% or greater.

Another patent which discloses corrosion-resistant, molybdenum-bearing, nickel alloys with high chromium contents is U.S. Pat. No. 5,529,642, although the preferred chromium range is 17 to 22 wt. %, and all compositions require the addition of tantalum, in the range 1.1 to 8 wt. %. Copper is optional in the alloys of U.S. Pat. No. 5,529,642, up to 4 wt. %.

Two further U.S. Pat. Nos. 4,778,576 and 4,789,449, disclose nickel alloys with wide-ranging chromium (5 to 30 wt. %) and molybdenum (3 to 25 wt. %) contents, for use as anodes in electrochemical cells. Both patents preferably claim anodes made from C-276 alloy, which contains 16 wt. % chromium and 16 wt. % molybdenum, but no copper.

SUMMARY OF THE INVENTION

The principal object of this invention is to provide new, wroughtable alloys with higher combined resistance to sulfuric acid and "wet process" phosphoric acid than previous alloys. It has been found that the above object may be achieved by adding chromium, molybdenum, and copper to nickel, within certain preferred ranges, together with elements required for sulfur and oxygen control, during melting, and unavoidable impurities. Specifically, the preferred ranges in weight percent are 30.0 to 35.0 chromium, 5.0 to 7.6 molybdenum, and 1.6 to 2.9 copper. The most preferred ranges in weight percent are 32.3 to 35.0 chromium, 5.0 to 6.6 molybdenum, and 1.6 to 2.9 copper.

For control of sulfur and oxygen, during argon-oxygen decarburization, up to 1.0 wt. % manganese, and up to 0.4 wt. % aluminum are preferred. Most preferred for this purpose are 0.22 to 0.29 manganese and 0.20 to 0.32 aluminum. Silicon and carbon are also necessary ingredients during argon-oxygen decarburization, levels up to 0.6 wt. % and 0.06 wt. %, respectively, being preferred. Nitrogen and iron are non-essential, but desirable, minor additions. Nitrogen levels up to 0.13 wt. % are preferred; iron levels up to 5.1 wt. % are preferred. With regard to likely impurities, up to 0.6 wt. % tungsten can be tolerated. Up to 5 wt. % cobalt can be used in place of nickel. It is anticipated that small quantities of other impurities, such as niobium, vanadium, and titanium would have little or no effect on the general characteristics of these materials.

DETAILED DESCRIPTION OF THE INVENTION

The discovery of the compositional range defined above involved study of a wide range of compositions, of varying chromium, molybdenum, and copper contents. These compositions are presented in Table 1, in order of increasing chromium contents, except for high molybdenum content alloy EN7101 at the end of the table. For comparison, this table also includes a copper-free alloy, EN2101. The results indicate that, with molybdenum contents in the range 5.0 to 7.6 wt. %, chromium contents in excess of 29.9 wt. % are necessary to improve upon the best of the existing alloys in "wet process" phosphoric acid. Surprisingly, the influence of chromium at contents of 32.3 wt. % and above is negligible. The results also indicate that an addition of 1.6 wt. % copper is sufficient to improve upon the best of the existing alloys in sulfuric acid, with chromium at 32.3 wt. % and above, and with molybdenum in the range 5.0 to 7.3 wt. %. Acceptable corrosion resistance in sulfuric acid was obtained at 7.6 wt. % molybdenum. Surprisingly, the effects of adding more copper were negligible.

TABLE 1

| | Ni | Cr | Mo | Fe | Mn | Al | Si | C | N | Cu | W | Co |
|---|---|---|---|---|---|---|---|---|---|---|---|---|
| EN4200 | BAL | 27.5 | 5.1 | 1.1 | 0.28 | 0.26 | 0.06 | 0.02 | N/A | 3 | N/A | N/A |
| EN4300 | BAL | 27.6 | 7.3 | 1.1 | 0.28 | 0.26 | 0.06 | 0.01 | N/A | 3.1 | N/A | N/A |
| EN6800 | BAL | 29.9 | 5.2 | 1.1 | 0.29 | 0.29 | 0.06 | 0.02 | N/A | 1.72 | N/A | N/A |
| EN295* | BAL | 32.3 | 6.4 | 1.2 | 0.23 | 0.26 | 0.05 | <0.01 | <0.01 | 2.9 | 0.06 | 0.05 |
| EN7000* | BAL | 32.5 | 5 | 1.2 | 0.25 | 0.32 | 0.2 | 0.02 | N/A | 1.6 | N/A | N/A |

TABLE 1-continued

| | Ni | Cr | Mo | Fe | Mn | Al | Si | C | N | Cu | W | Co |
|---|---|---|---|---|---|---|---|---|---|---|---|---|
| EN2101 | BAL | 32.9 | 5.1 | 1 | 0.28 | 0.26 | 0.33 | 0.04 | N/A | <0.01 | N/A | N/A |
| EN495* | BAL | 33.2 | 6.5 | 5 | 0.28 | 0.24 | 0.05 | 0.01 | <0.01 | 2 | 0.01 | <0.01 |
| EN7001* | BAL | 34.5 | 7.6 | 1.1 | 0.27 | 0.24 | 0.25 | 0.03 | <0.01 | 1.72 | 0.04 | N/A |
| EN395* | BAL | 34.7 | 6.5 | 1 | 0.29 | 0.23 | 0.06 | <0.01 | <0.01 | 2.1 | 0.02 | <0.01 |
| EN502* | BAL | 34.8 | 6.6 | 1.1 | 0.26 | 0.21 | 0.29 | 0.03 | <0.01 | 2 | 0.09 | N/A |
| EN595* | BAL | 35 | 6.6 | 5.1 | 0.28 | 0.24 | 0.06 | <0.01 | <0.01 | 1.9 | 0.02 | <0.01 |
| EN1402* | BAL | 35 | 6.6 | 1 | 0.22 | 0.2 | 0.3 | 0.03 | 0.06 | 1.8 | N/A | N/A |
| EN602 | BAL | 35.3 | 8.2 | 1.6 | 2.2 | 0.4 | 0.65 | 0.07 | 0.15 | 2.5 | 0.76 | 2 |
| EN7101 | BAL | 34.7 | 10.2 | 3 | 1.1 | 0.43 | 0.81 | 0.14 | 0.22 | 1.2 | 1.17 | — |

N/A = Not Analyzed
*Alloys of the present invention

For comparison, G-30 alloy, Alloy 31, Alloy 28, and C-276 alloy were also tested. The preferred alloys of U.S. Pat. Nos. 5,424,029 (Alloy A) and 5,529,642 (Alloy 13), and the closest alloy of U.S. Pat. No. 5,529,642 (Alloy 37) were also melted and tested (where possible). The compositions of these prior art alloys are given in Table 2.

TABLE 2

| | Ni | Cr | Mo | Fe | Mn | Al | Si | C | N | Cu | OTHER |
|---|---|---|---|---|---|---|---|---|---|---|---|
| G-30 | BAL | 29.9 | 4.9 | 14 | 1.1 | 0.16 | 0.32 | 0.01 | — | 1.5 | Co: 0.6 W: 2.7 nB: 0.8 |
| 31 | 32 | 27 | 6.5 | BAL | 1.5 | — | 0.09 | <0.01 | 0.19 | 1.3 | — |
| 28 | 30.7 | 26.8 | 3.5 | BAL | 1.5 | — | 0.3 | 0.01 | — | 1.2 | — |
| C-276 | BAL | 15.6 | 15.4 | 6 | 0.5 | 0.23 | 0.04 | <0.01 | 0.02 | 0.07 | Co: 1.5 W: 4 V: 0.15 |
| A | BAL | 31 | 10.1 | 0.1 | <0.01 | 0.25 | 0.02 | 0.03 | <0.01 | 0.01 | W: 2.3 Nb: 0.44 Ti: 0.28 |
| 13 | BAL | 20.5 | 22.1 | 0.07 | 0.52 | 0.02 | 0.11 | 0.02 | <0.01 | <0.01 | Ta: 1.9 |
| 37 | BAL | 34.8 | 8.3 | 0.1 | 0.73 | 0.02 | 0.21 | 0.03 | <0.01 | <0.01 | Ta: 4.9 W: 3.9 |

The experimental alloys, and the prior art alloys of U.S. Pat. Nos. 5,424,029 and 5,529,642, were vacuum induction melted, then electro-slag remelted, at a heat size of 50 lb. The ingots so produced were soaked, then forged and rolled, at 1204° C. Surprisingly, Alloys 13 and 37 of U.S. Pat. No. 5,529,642 cracked so badly during forging and rolling that they had to be scrapped (at thicknesses of 2 in and 1.2 in, respectively). Also, EN602 and EN7101 cracked so badly during forging that they had to be scrapped at a thickness of 1 in. and 2 in. respectively. Those alloys which were successfully rolled to the required test thickness of 0.125 in were subjected to annealing trials, to determine the most suitable annealing treatment. In all cases, this was 15 min at 1149° C., followed by water quenching. G-30 alloy, Alloy 31, Alloy 28, and C-276 alloy were all tested in the condition sold by the manufacturer, the so-called "mill annealed" condition.

Prior to testing of the experimental and prior art alloys, it was established that 54 wt. % was a particularly corrosive concentration of "wet process" phosphoric acid ($P_2O_5$), at 135° C. Therefore, all the alloys successfully rolled to sheets of thickness 0.125 in were tested in this environment, along with similar sheets of the commercial alloys. The tests were carried out in autoclaves for a duration of 96 hours without interruption. To assess the resistance to sulfuric acid of the alloys, a concentration of 50 wt. % at 93° C. was used, again for a test duration of 96 hours without interruption. The surfaces of all samples were manually ground prior to test, to negate any mill finish effects.

The results of testing are given in Table 3. In essence, alloys of the present invention possess similar or higher resistance to sulfuric acid than the most resistant prior art material, C-276 alloy, and higher resistance to "wet process" phosphoric acid than the most resistant prior art material, alloy A of U.S. Pat. No. 5,424,029. Since the resistance of C-276 alloy to "wet process" phosphoric acid is relatively poor, and since the resistance of alloy A to sulfuric acid is relatively poor, this combination of properties in the alloys of this invention is regarded as a significant and surprising improvement. Moreover, this combination of properties was accomplished without the use of tungsten and tantalum, regarded as mandatory additions in U.S. Pat. Nos. 5,424,029 and 5,529,642, respectively. Also, it was accomplished at copper levels stated in U.S. Pat. No. 5,424,029 to be detrimental to corrosion resistance. Although molybdenum is known to benefit the resistance of nickel alloys to general corrosion, the results indicate that sulfuric acid resistance decreases as molybdenum is increased from 6.6 to 7.6 wt. %, in this system. Alloys having over 8% molybdenum could not be processed.

Many of the alloys of this invention have electron vacancy numbers greater than 2.7, suggesting that they might not be amenable to hot banding, a rolling process designed to produce 0.25 inch thick coils for cold rolling at minimal cost. Nevertheless, it has been shown, during the course of the experimental work, that they are amenable to conventional hot forging and hot rolling, unlike Alloys 13 and 37 of U.S. Pat. No. 5,529,642.

TABLE 3

| | CORROSION RATE IN 54% $P_2O_5$ AT 135° C. (mm/y) | CORROSION RATE IN 50% $H_2SO_4$ at 93° C. (mm/y) |
|---|---|---|
| EN4200 | 0.43 | 0.25 |
| EN4300 | 0.4 | 0.27 |
| EN6800 | 0.34 | 0.29 |
| EN295* | 0.26 | 0.3 |
| EN7000* | 0.26 | 0.31 |
| EN2101 | 0.28 | 113.7 |
| EN495* | 0.25 | 0.34 |
| EN7001* | 0.29 | 0.46 |

TABLE 3-continued

| | CORROSION RATE IN 54% $P_2O_5$ AT 135° C. (mm/y) | CORROSION RATE IN 50% $H_2SO_4$ at 93° C. (mm/y) |
|---|---|---|
| EN395* | 0.22 | 0.38 |
| EN502* | 0.29 | 0.32 |
| EN595* | 0.24 | 0.41 |
| EN1402 | 0.27 | 0.32 |
| EN602 | UNABLE TO PROCESS | |
| EN7101 | UNABLE TO PROCESS | |
| G-30 | 0.43 | 0.45 |
| 31 | 0.53 | 2.51 |
| 28 | 0.64 | 0.67 |
| C-276 | 1.53 | 0.42 |
| A (PATENT 5,424,029) | 0.34 | 1.91 |
| 13 (PATENT 5,529,642) | UNABLE TO PROCESS | |
| 37 (PATENT 5,529,642) | UNABLE TO PROCESS | |

*Alloys of the present invention

Several observations may be made concerning the general effects of the alloying elements, as follows:

Chromium (Cr) is a primary alloying element. It provides high resistance to "wet process" phosphoric acid. The preferred chromium range is 30.0 to 35.0 wt. %. Below 30.0 wt. %, the alloys have insufficient resistance to "wet process" phosphoric acid; above 35.0 wt. %, the alloys cannot be hot forged and hot rolled into wrought products, by conventional means. The most preferred chromium range is 32.3 to 35.0 wt. %.

Molybdenum (Mo) is also a primary alloying element. It is known to enhance the general corrosion resistance of nickel alloys. The preferred molybdenum range is 5.0 to 7.6 wt. %. Below 5.0 wt. %, the alloys would have insufficient resistance to general corrosion; above 7.6 wt. %, the alloys have insufficient resistance to sulfuric acid. The most preferred molybdenum range is 5.0 to 6.6 wt. %.

Copper (Cu) is also a primary alloying element. It strongly enhances the resistance of the alloys to sulfuric acid. The preferred copper range is 1.6 to 2.9 wt. %. Below 1.6 wt. %, the alloys have insufficient resistance to sulfuric acid; above 2.9 wt. %, the alloy would contribute to thermal instability, hence restrict wrought processing, and impair the properties of weldments.

Manganese (Mn) is used for the control of sulfur. It is preferred at levels up to 1.0 wt. %, and more preferably, with electric arc melting followed by argon-oxygen decarburization, in the range 0.22 to 0.29 wt. %. Above a level of 1.0 wt. %, manganese contributes to thermal instability. Acceptable alloys with very low manganese levels might be possible with vacuum melting.

Aluminum (Al) is used for the control of oxygen, molten bath temperature, and chromium content, during argon-oxygen decarburization. The preferred range is up to 0.4 wt. %, and the more preferred, with electric arc melting followed by argon-oxygen decarburization, is 0.20 to 0.32 wt. %. Above 0.4 wt. %, aluminum contributes to thermal stability problems. Acceptable alloys with very low aluminum levels might be possible with vacuum melting.

Silicon (Si) is necessary for elemental control, during argon-oxygen decarburization. The preferred range is up to 0.6 wt. %. Forging problems, due to thermal instability, are expected at silicon levels in excess of 0.6 wt. %. Acceptable alloys with very low silicon contents might be possible with vacuum melting.

Carbon (C) is also necessary for elemental control, although it is reduced as much as possible during argon-oxygen decarburization. The preferred carbon range is up to 0.06 wt. %, beyond which it contributes to thermal instability, through the promotion of carbides in the microstructure. Acceptable alloys with very low carbon contents might be possible with vacuum melting, and high purity charge materials.

Nitrogen (N) is a non-essential but desirable minor addition, which will normally be present in air-melted materials, due to its high solubility in high chromium alloys. The preferred range is up to 0.13 wt. %, beyond which it contributes to thermal instability.

Iron (Fe) is a non-essential but desirable minor addition, since its presence allows the economic use of revert materials, most of which contain residual amounts of iron. Up to 5.1 wt. % iron can be tolerated in the alloys of this invention, above which it contributes to thermal instability. An acceptable, iron-free alloy might be possible, using new furnace linings and high purity charge materials, especially if vacuum melting techniques are employed.

It has been shown that common impurities can be tolerated. In particular, it has been shown that tungsten can be tolerated up to 0.6 wt. %. Up to 5 wt. % cobalt can be used in place of nickel but the preferred level is up to 1.75 wt. %. Elements such as niobium, titanium, vanadium, and tantalum, which promote the formation of nitrides and other second phases, should be held at low levels, for example, less than 0.2 wt. %. Other impurities that might be present at low levels include sulfur, phosphorus, oxygen, magnesium, and calcium (the last two of which are involved with deoxidation).

Even though the samples tested were all wrought sheets, the alloys should exhibit comparable properties in other wrought forms (such as plates, bars, tubes and wires) and in cast and powder metallurgy forms. Consequently, the present invention encompasses all forms of the alloy composition.

Although we have disclosed certain present preferred embodiments of the alloy, it should be distinctly understood that the present invention is not limited thereto but may be variously embodied within the scope of the following claims.

What is claimed is:

1. A nickel-chromium-molybdenum-copper alloy resistant to sulfuric acid and "wet process" phosphoric acid, consisting essentially of:

30.0 to 35.0 wt. % Chromium
5.0 to 7.6 wt. % Molybdenum
1.6 to 2.9 wt. % Copper
Up to 1.0 wt. % Manganese
Up to 0.4 wt. % Aluminum
Up to 0.6 wt. % Silicon
Up to 0.06 wt. % Carbon
Up to 0.13 wt. % Nitrogen
Up to 5.1 wt. % Iron
Up to 5.0 wt. % Cobalt
with a balance of nickel and impurities.

2. The nickel-chromium-molybdenum-copper alloy of claim 1, consisting essentially of:

32.3 to 35.0 wt. % Chromium
5.0 to 6.6 wt. % Molybdenum
1.6 to 2.9 wt. % Copper
0.22 to 0.29 wt. % Manganese
0.20 to 0.32 wt. % Aluminum
Up to 0.6 wt. % Silicon
Up to 0.06 wt. % Carbon
Up to 0.13 wt. % Nitrogen Up to 5.1 wt. % Iron with a balance of nickel and impurities.

3. The nickel-chromium-molybdenum-copper alloy of claim 1, wherein cobalt is present up to 1.75 wt. %.

4. The nickel-chromium-molybdenum-copper alloy of claim 1, wherein the impurities comprise up to 0.6 wt. % tungsten.

5. The nickel-chromium-molybdenum-copper alloy of claim 1, wherein the impurities comprise levels of at least one of niobium, titanium, vanadium, tantalum, sulfur, phosphorus, oxygen, magnesium, and calcium.

6. The nickel-chromium-molybdenum-copper alloy of claim 1, wherein the alloys are in wrought forms selected from the group consisting of sheets, plates, bars, wires, tubes, pipes, and forgings.

7. The nickel-chromium-molybdenum-copper alloy of claim 1, wherein the alloy is in cast form.

8. The nickel-chromium-molybdenum-copper alloy of claim 1, wherein the alloy is in powder metallurgy form.

* * * * *